US008297464B2

(12) United States Patent
Grenier et al.

(10) Patent No.: US 8,297,464 B2
(45) Date of Patent: Oct. 30, 2012

(54) CARRYING CASE WITH LOCKING LATCH MECHANISM

(76) Inventors: Jean-Pierre Grenier, Blainville (CA); Benjamin Coley, La Plaine (CA); Gary Hawkins, Dollard-des-Ormeaux (CA)

( * ) Notice: Subject to any disclaimer, the term of this patent is extended or adjusted under 35 U.S.C. 154(b) by 985 days.

(21) Appl. No.: 12/132,654

(22) Filed: Jun. 4, 2008

(65) Prior Publication Data

US 2008/0307835 A1 Dec. 18, 2008

Related U.S. Application Data

(63) Continuation-in-part of application No. 11/762,497, filed on Jun. 13, 2007, now abandoned.

(51) Int. Cl.
*B65D 45/16* (2006.01)

(52) U.S. Cl. ..... 220/326; 220/324; 220/314; 292/113

(58) Field of Classification Search ..... 220/326, 220/314, 4.22, 4.23, 4.24, 324; 70/73; 292/113, 292/95, 247, 116; 206/1.5
See application file for complete search history.

(56) References Cited

U.S. PATENT DOCUMENTS

| | | | | |
|---|---|---|---|---|
| 2,795,946 | A * | 6/1957 | Check | 70/76 |
| 3,936,082 | A * | 2/1976 | Swanson | 292/113 |
| D353,048 | S | 12/1994 | VanSkiver et al. | |
| 5,556,145 | A | 9/1996 | Takasaki | |
| 5,570,915 | A | 11/1996 | Asadurian | |
| 5,578,794 | A | 11/1996 | Lamb et al. | |
| 5,655,799 | A | 8/1997 | Takimoto | |
| 5,924,533 | A | 7/1999 | Cnockaert et al. | |
| D419,768 | S | 2/2000 | Richardson et al. | |
| 6,173,592 | B1 | 1/2001 | Yu | |
| D439,407 | S | 3/2001 | Parker | |
| D441,954 | S | 5/2001 | Parker | |
| D462,519 | S | 9/2002 | Gaydos et al. | |
| D467,425 | S | 12/2002 | Hardigg et al. | |
| D467,426 | S | 12/2002 | Hardigg et al. | |
| 6,513,689 | B2 * | 2/2003 | Vincenzo | 224/435 |
| D471,711 | S | 3/2003 | Addison | |
| D472,384 | S | 4/2003 | Richardson | |
| 6,547,293 | B1 * | 4/2003 | Cheng | 292/247 |
| 6,953,126 | B2 | 10/2005 | Parker et al. | |
| 6,955,381 | B2 | 10/2005 | Parker et al. | |
| D516,309 | S | 3/2006 | Richardson et al. | |
| D520,237 | S | 5/2006 | Cheng | |
| D523,242 | S | 6/2006 | Hardigg et al. | |
| 7,370,891 | B1 * | 5/2008 | Schmitt et al. | 292/113 |
| 2005/0001435 | A1 | 1/2005 | Parker et al. | |
| 2006/0042897 | A1 | 3/2006 | Sanderson | |
| 2006/0278485 | A1 | 12/2006 | Toneli | |
| 2008/0196216 | A1 | 8/2008 | Chi-Chai | |

FOREIGN PATENT DOCUMENTS

| | | | |
|---|---|---|---|
| FR | 2681370 | A1 | 3/1993 |
| WO | 9602424 | A1 | 2/1996 |

* cited by examiner

*Primary Examiner* — J. Gregory Pickett
*Assistant Examiner* — Ernesto Grano
(74) *Attorney, Agent, or Firm* — GrayRobinson, PA

(57) ABSTRACT

A carrying case includes a top case shell hinged to a bottom case shell which may be maintained in a closed position by a double throw, triple action latch mechanism comprising a latch body pivotally mounted to the bottom case shell, a latch locking element pivotally mounted to the latch body and a latch release coupled to the latch body. With the case in the closed position, the latch locking element engages a seat formed in the top case shell and clamps the two shells together. After moving the latch release to a release position, the latch body may be pivoted relative to the bottom case shell to permit disengagement of the latch locking mechanism from the top shell allowing the case to be opened.

6 Claims, 13 Drawing Sheets

CARRYING CASE WITH LOCKING LATCH MECHANISM

RELATED APPLICATION

This application is a continuation-in-part application of U.S. patent application Ser. No. 11/762,497 filed Jun. 13, 2007, for all commonly disclosed subject matter. U.S. application Ser. No. 11/762,497 is expressly incorporated herein by reference in its entirety to form part of the present disclosure.

FIELD OF THE INVENTION

This invention relates to carrying cases, and, more particularly, to carrying cases with a double throw, triple action latch mechanism having a locking feature which substantially prevents inadvertent opening of the latch mechanism.

BACKGROUND OF THE INVENTION

Carrying cases typically include a top case shell and a bottom case shell pivotally connected by a hinge. The two shells are maintained in a closed position by one or more latch mechanisms located along the front and/or the sides of the case. A variety of latch mechanisms have been employed in the past, such as single throw and double throw latches, some of which may be locked with combination locks or key locks.

Carrying cases intended for the transport of valuable items, and items which are relatively fragile, are preferably rugged in construction and not subject to inadvertent opening. While combination locks or key locks may reduce the incidence of inadvertent opening of a case, such features are more suitable for cases intended for use by one individual, e.g. brief cases and the like. If a carrying case may be used by several people, it is difficult to convey the combination of a lock to a group, whose members may change, and keys are easily lost. Further, security requirements at airports do not permit locking of cases or luggage, and such cases may be inadvertently opened by baggage handlers. There is therefore a need for a carrying case having a rugged construction with a locking feature which substantially prevents inadvertent opening of the case without the use of combination locks, key locks or the like.

SUMMARY OF THE INVENTION

This invention is directed to a carrying case with a latch mechanism having a locking feature which prevents inadvertent opening of the case.

In the presently preferred embodiment, the carrying case of this invention includes a top case shell and a bottom case shell pivotally connected by a hinge. A double throw, triple action latch mechanism maintains the case shells in the closed position. The latch mechanism comprises a latch body pivotally mounted to the bottom case shell, a latch locking element pivotally mounted to the latch body and a latch release coupled to the latch body. With the case in the closed position, the latch locking element engages a seat formed in the top case shell and clamps the two shells together. In response to pivotal motion of the latch body, the latch locking element may be disengaged from the top shell allowing the case to be opened.

The purpose of the latch release is to prevent inadvertent pivotal motion of the latch body, which, in turn, would allow the latch locking element to disengage the top case shell. As described in detail below, the latch release is movable between a locked position and a release position. In the locked position, the latch release engages the front wall of the bottom case shell and prevents pivotal motion of the latch body. In turn, the latch locking element is maintained in position against the seat of the top case shell thus retaining the case in the closed position. Upon movement of the latch release to the release position, the latch body is free to pivot thus allowing the latch locking element to disengage from the top case shell.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
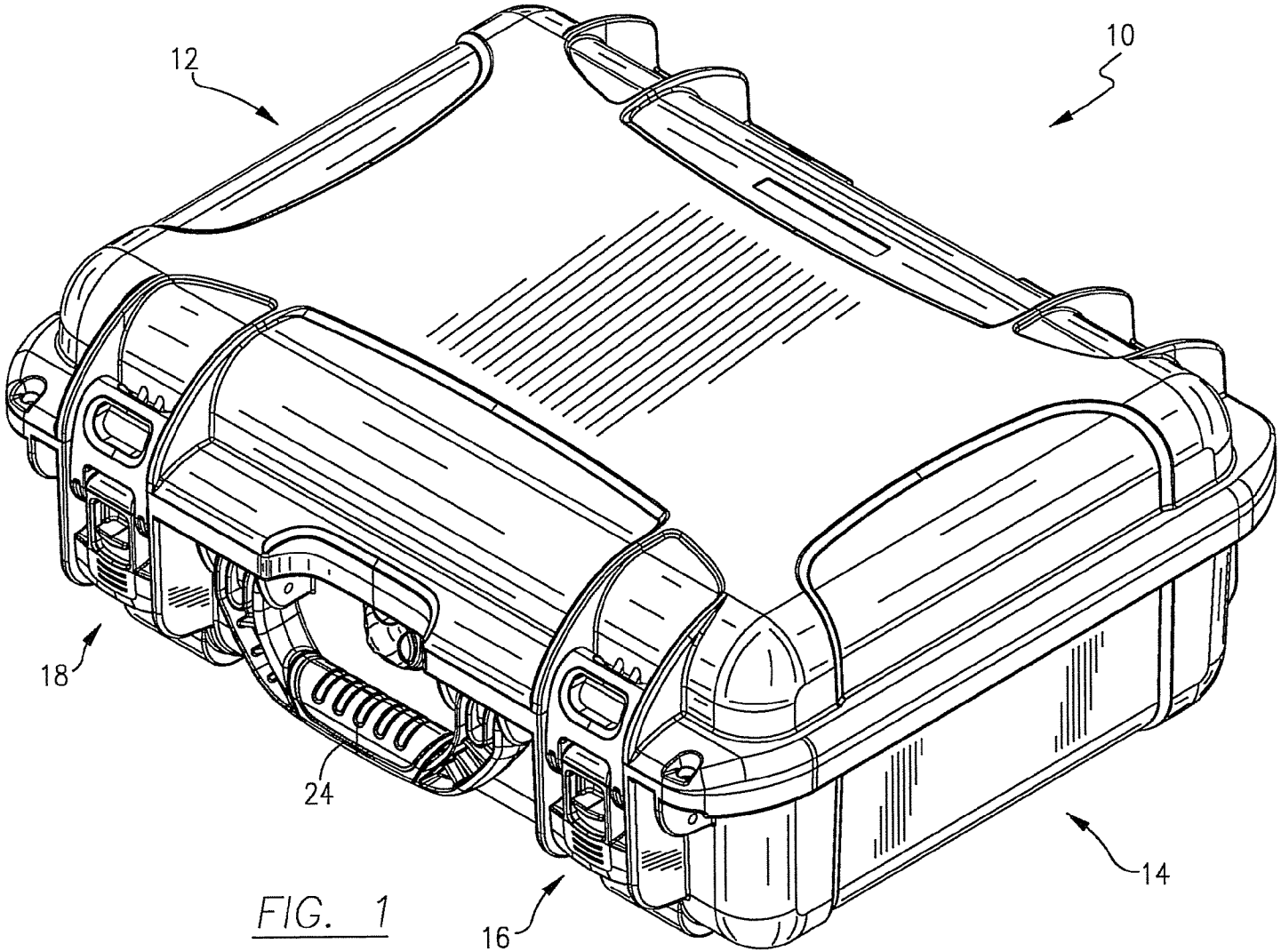
FIG. 1 is perspective view of the carrying case with the latch mechanism of this invention.
Figure 2:
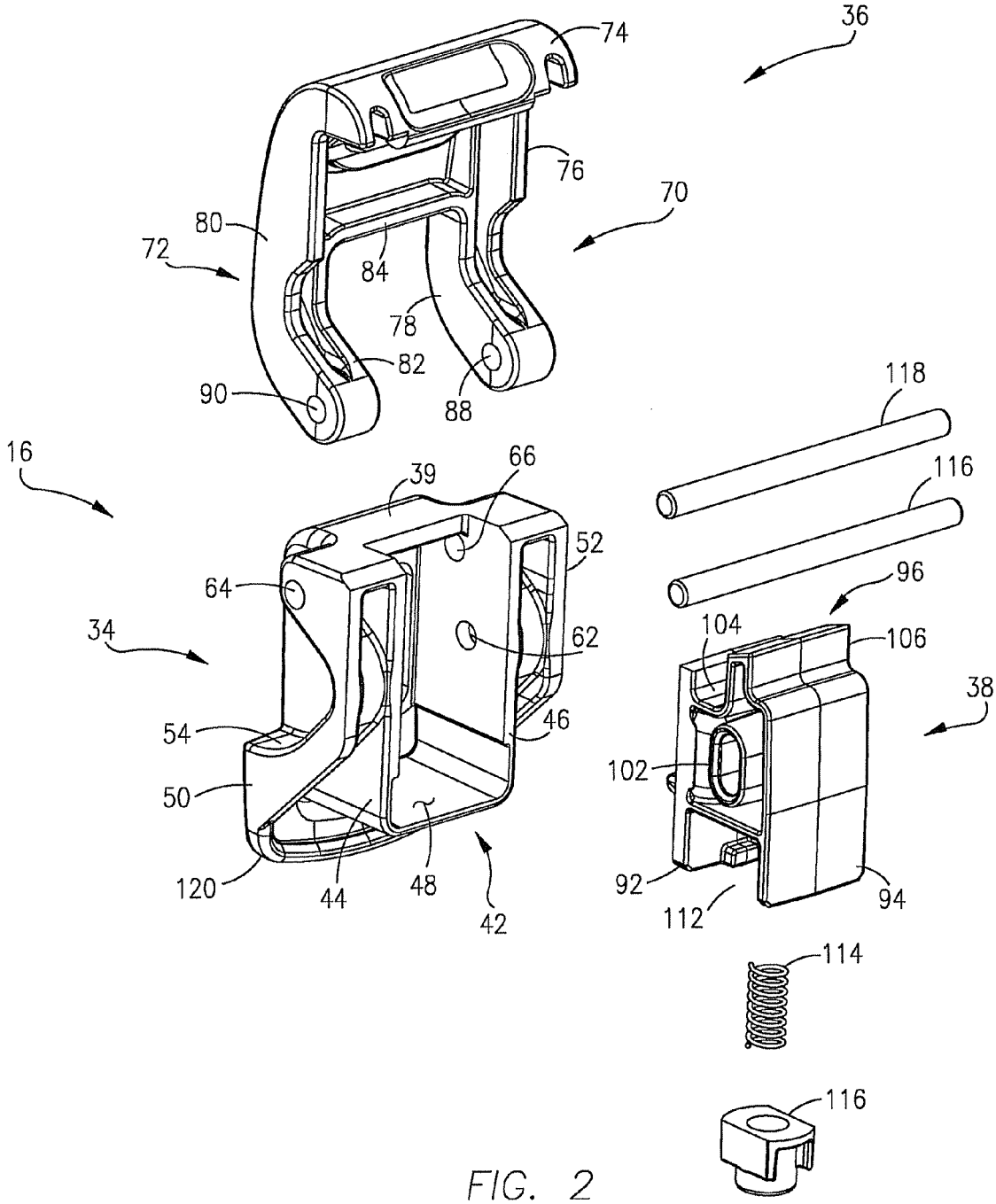
FIG. 2 is an exploded, disassembled perspective view of the components forming the latch mechanism herein.
Figure 6:
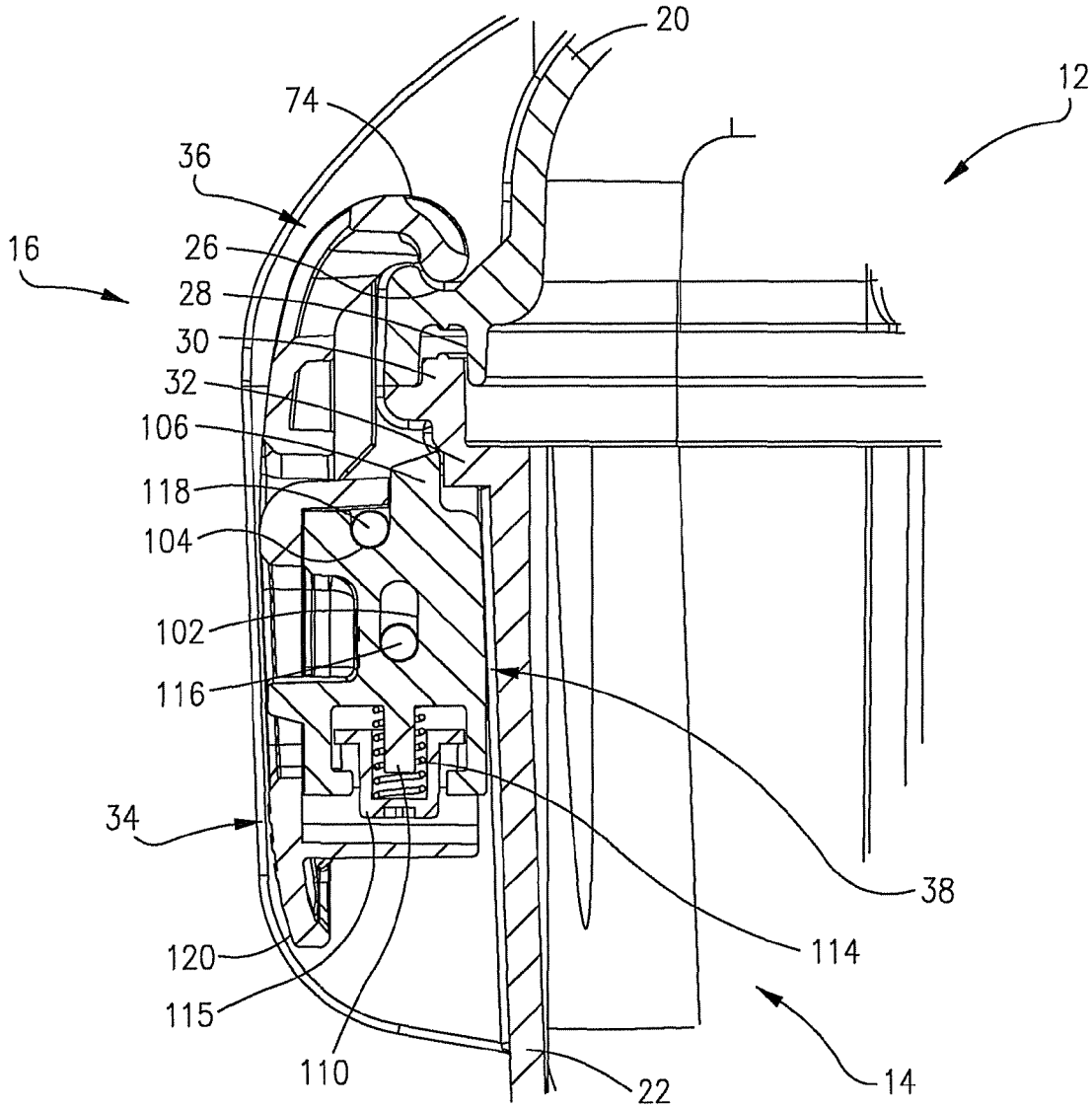
FIG. 6 is a cross sectional view of the latch mechanism mounted to the carrying case with the case closed and the latch release in the locked position.

Referring initially to FIGS. 1 and 6, a carrying case 10 is depicted having a top case shell 12 pivotally connected to a bottom case shell 14. Two latch mechanisms 16 and 18 are located along the front wall 20 of shell 12 and front wall 22 of shell 14 on either side of a handle 24. As best shown in FIG. 6, the front wall 20 of top case shell 12 is formed with a seat 26 and a downwardly facing slot 28 which receives the upper edge 30 of the front wall 22 of bottom case shell 14 when the case 10 is closed. The front wall 22 of the bottom case shell 14 is formed with a ledge 32, for purposes to become apparent below. Except as noted above, the detailed construction of the case 10 forms no part of this invention and is not described herein. Additionally, for purposes of the present discussion, the terms "top," "bottom," "upper," "lower," "downwardly," "upwardly" and the like refer to the vertical orientation of the case as it is depicted in the Figs.

Figure 3:
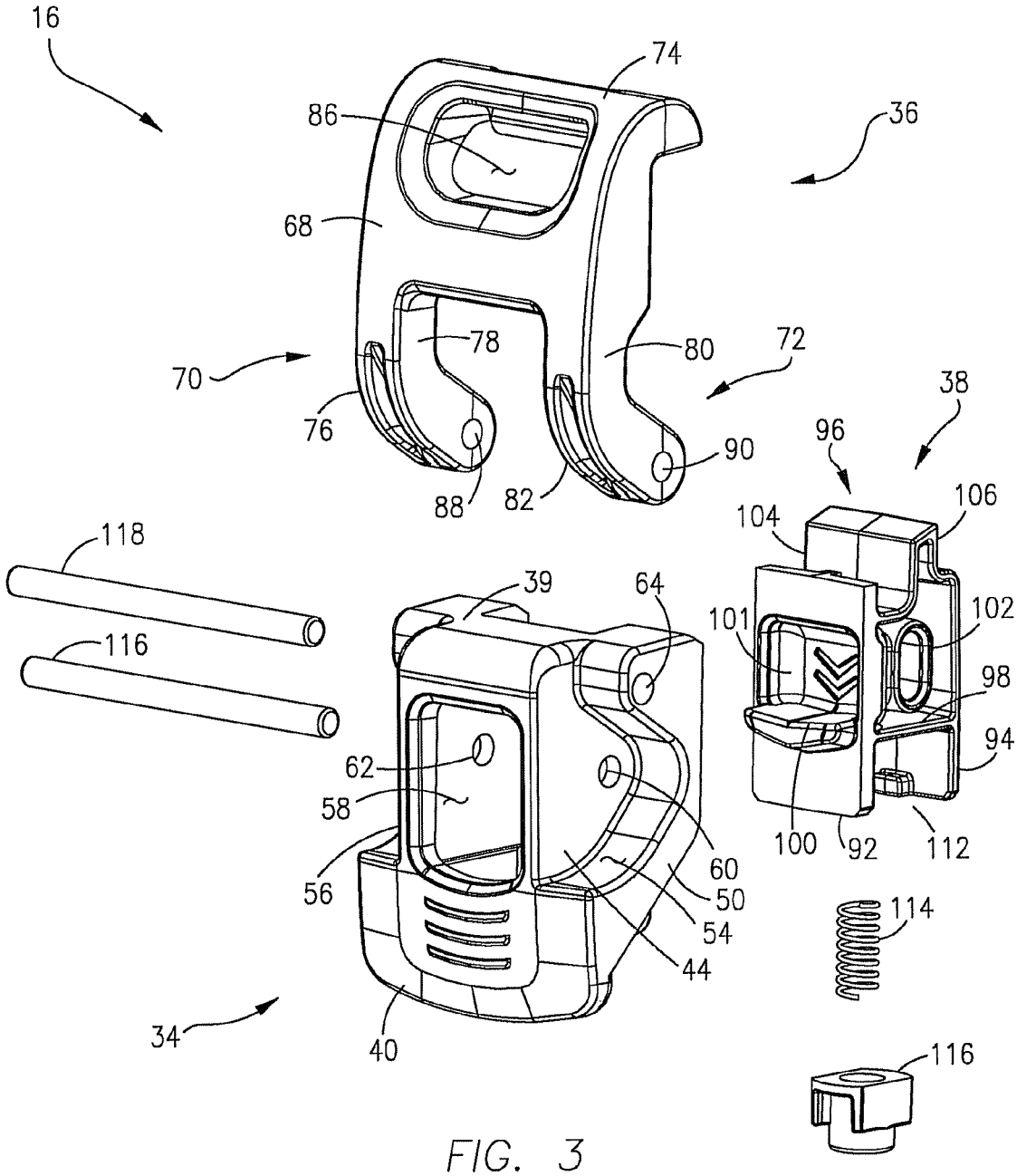
FIG. 3 is view similar to FIG. 2, except viewing the latch mechanism from the front.

With reference to FIGS. 2-5, the latch mechanism 16 of this invention is shown in detail. It should be understood that the two latch mechanisms 16, 18 are identical to one another, and therefore only the latch mechanism 16 is discussed herein. The latch mechanism 16 comprises a latch body 34, a latch locking element 36 and a latch release 38. The latch body 34 includes a top wall 39, a front wall 40, and, a cavity 42 defined by spaced inner side walls 44 and 46, a bottom wall 48 and a portion of the top wall 39. An outer side wall 50 is spaced from the inner side wall 44 and an outer side wall 52 is spaced from the other, inner side wall 46 forming a bearing surface 54 between the side walls 44 and 50 and a bearing surface 56 between the side walls 46 and 52. As best seen in FIG. 3, the front wall 40 of latch body 34 is formed with a window 58 to provide access to the latch release 38, as described below. Aligning bores 60 and 62 are formed in the inner side walls 44 and 46, respectively. Additionally, a bore 64 is formed in each of the inner and outer walls 44, 50 which aligns with a bore 66 formed in the inner and outer walls 46 and 52.

The latch locking element 36 comprises a front wall 68, spaced pivot arms 70 and 72 and a hook element 74. The pivot arm 70 is formed by an outer side plate 76 and an inner side plate 78. Similarly, the pivot arm 72 is formed by an outer side plate 80 and an inner side plate 82. A cross brace 84 spans the inner side plates 78 and 82. The front wall 68 has an opening 86, and the two pivot arms 70, 72 are formed with a through bore 88, 90, respectively.

The latch release 38 is sized and shaped to fit within the cavity 42 formed in the latch body 34. It includes a front wall 92, a back wall 94, a top wall 96 and a bottom wall 98 which are interconnected and collectively form a hollow interior within which a sleeve 102 is mounted. A button 100 extends from the bottom wall 98 through an opening 101 in the front wall 92. The top wall 96 has a recess 104 and an upwardly extending locking member 106 with a tapered top surface. As best seen in FIGS. 6-9, a cylindrical-shaped projection 110 is mounted to the underside of the bottom wall 98. The projection 110 is located within an opening 112 defined by the lower ends of the front wall 92 and back wall 94 which extend beyond the bottom wall 98. A coil spring 114 encircles the projection 110 and seats within a spring holder 115.

Figure 4:
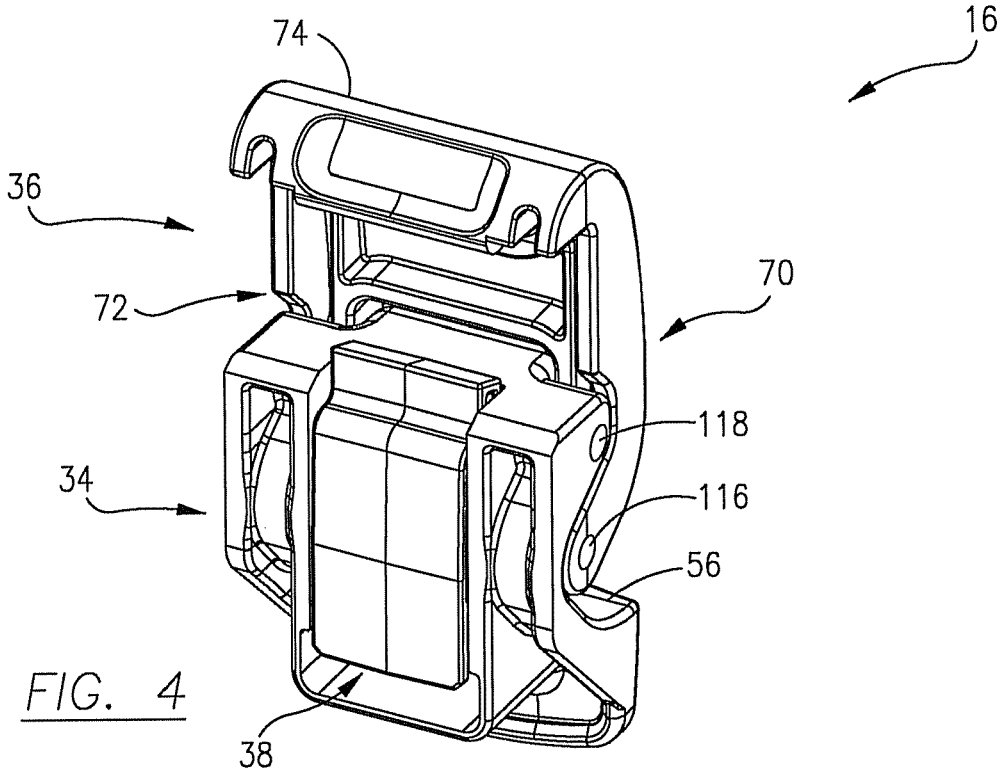
FIG. 4 is an assembled, rear perspective view of the latch mechanism.
Figure 5:
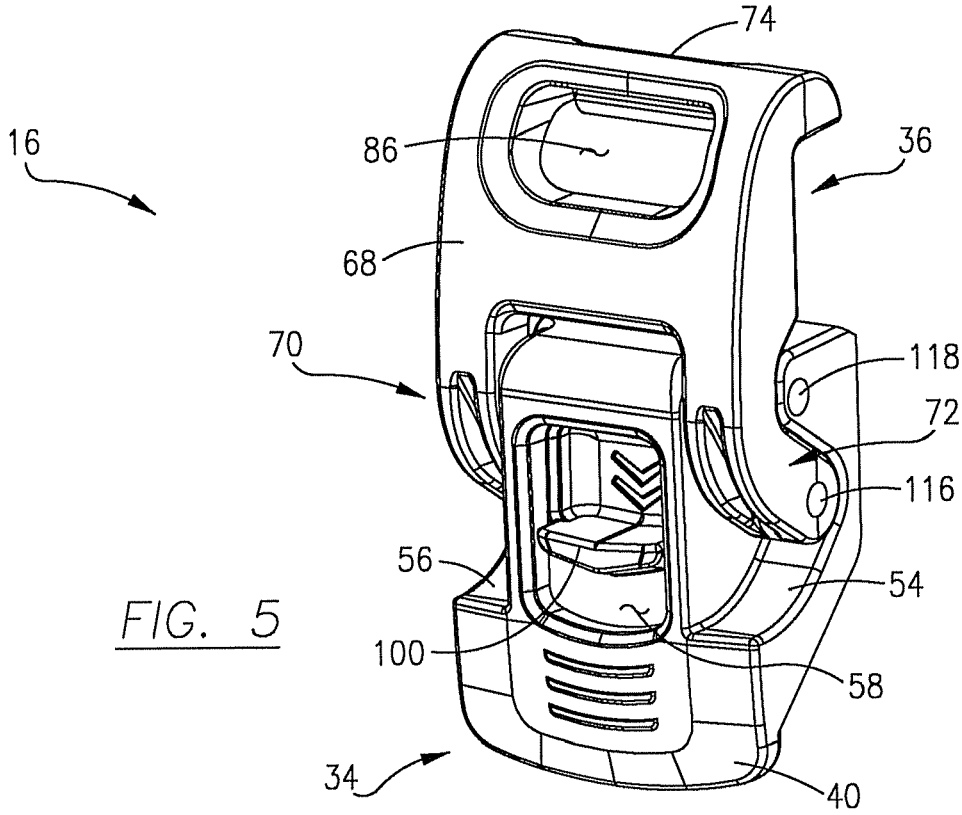
FIG. 5 is a view similar to FIG. 4, except viewing the assembled latch mechanism from the front.

The latch mechanism 16 is assembled by first inserting the latch release 38 within the cavity 42 of the latch body 34. The lower ends of the front and back walls 92, 94 of the latch release 38, and the holder 115, rest atop the bottom wall 48 of the latch body 34. The latch locking element 36 is then placed on the latch body 34 so that the pivot arm 70 rests atop the bearing surface 56 of the latch body 34, and the pivot arm 72 engages the bearing surface 54. With the latch locking element 36 and the latch release 38 in this position, a latch assembly pin 116 may be inserted through the bore 88 of pivot arm 70, through the bore 62 in the inner side wall 46 of the latch body 34, into the sleeve 102 of the latch release 38, through the bore 60 in the inner side wall 44 of latch body 34 and then into the bore 90 of pivot arm 72. This secures both the latch locking element 36 and the latch release 38 to the latch body 34, as depicted in FIGS. 4 and 5. The assembled latch mechanism 16 is pivotally connected to the bottom case shell 14 of the case 10 by a case mounting pin 118 which extends through the aligning bores 64 and 66 formed in the latch body 34.

Operation of Latch Mechanism of FIGS. 1-5

Figure 7:
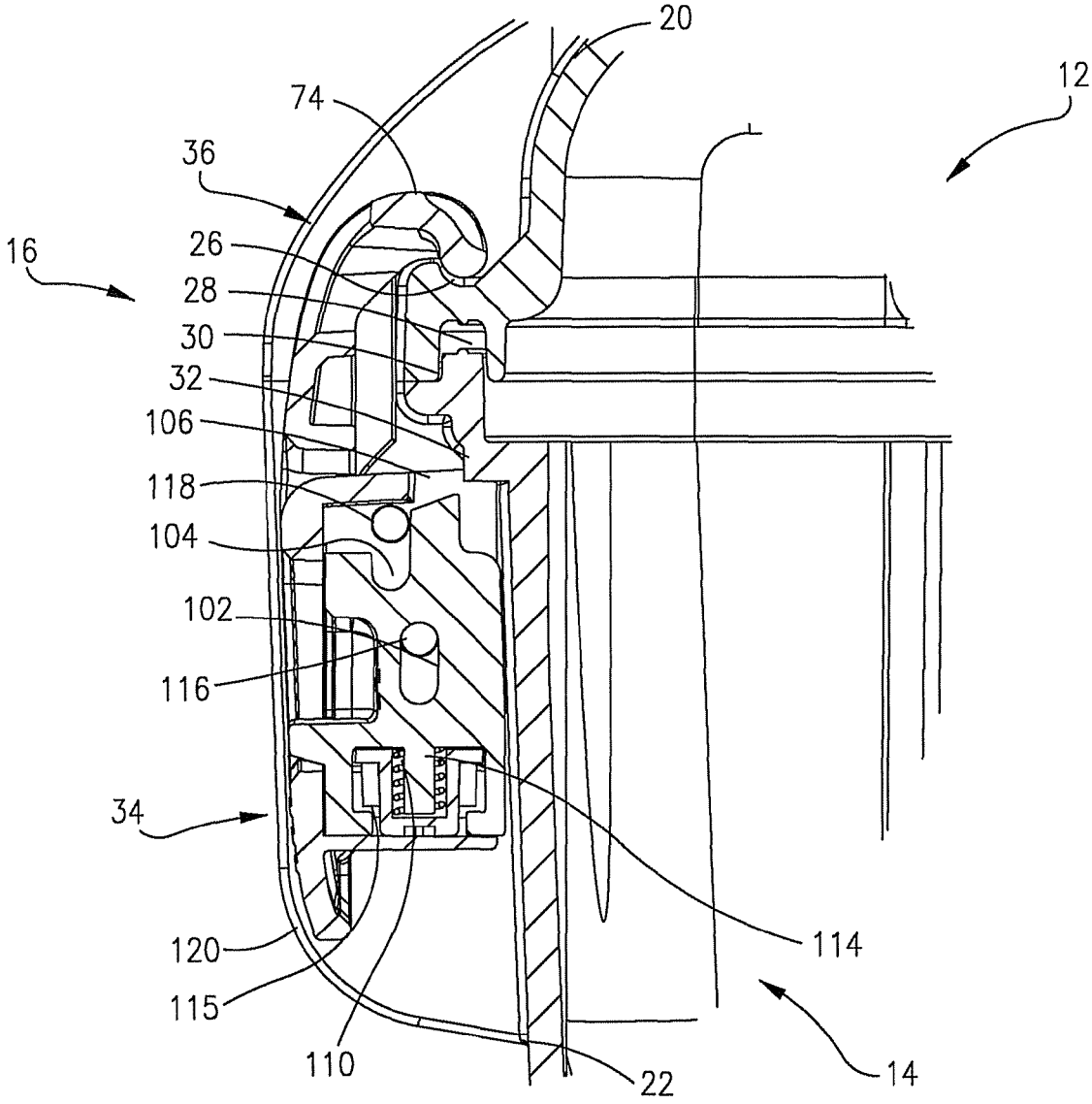
FIG. 7 is a view similar to FIG. 6 except with the latch release moved to the release position.
Figure 8:
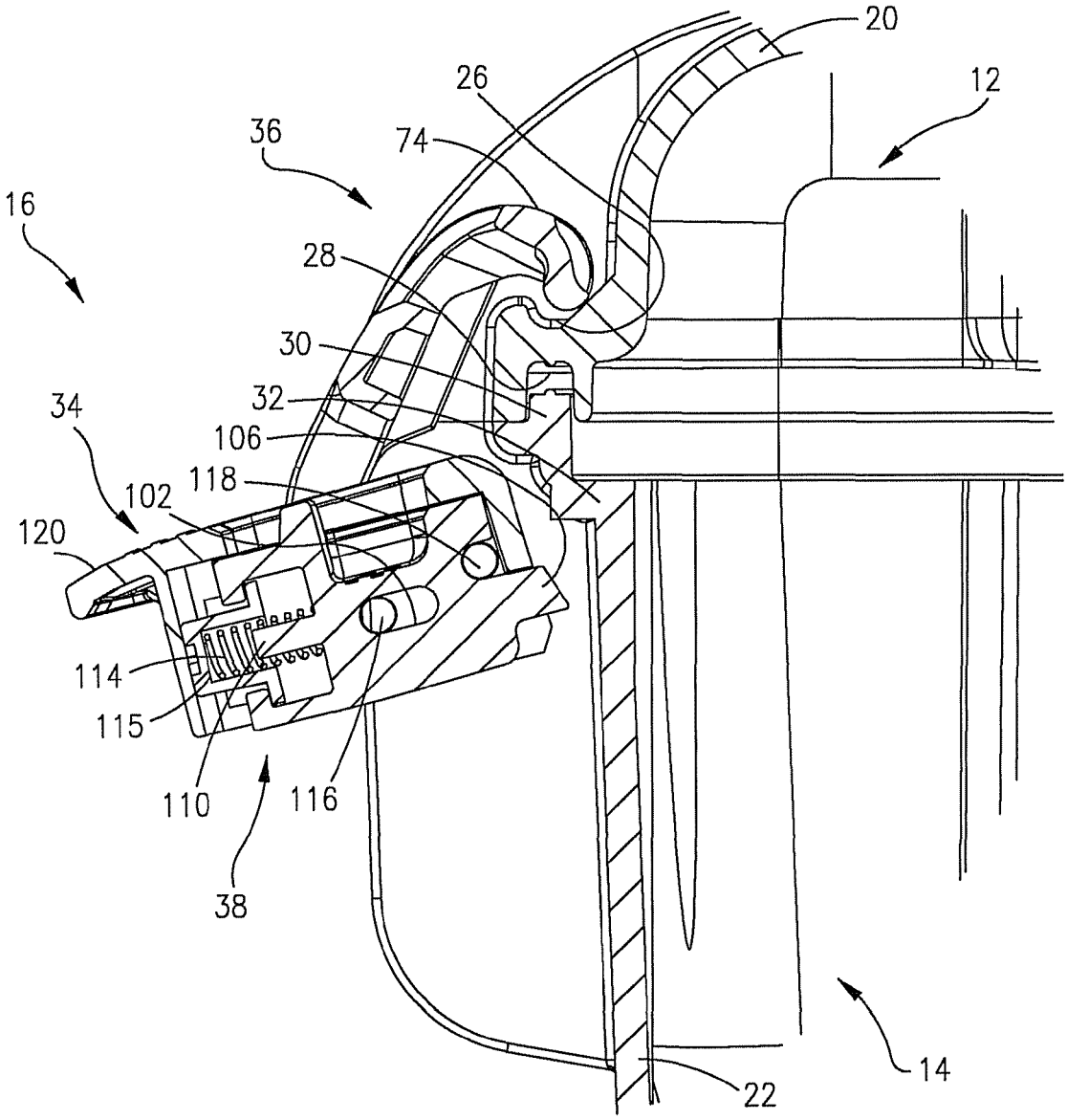
FIG. 8 is a view similar to FIG. 6 except with the latch release pivoted relative to the bottom shell of the case.
Figure 9:
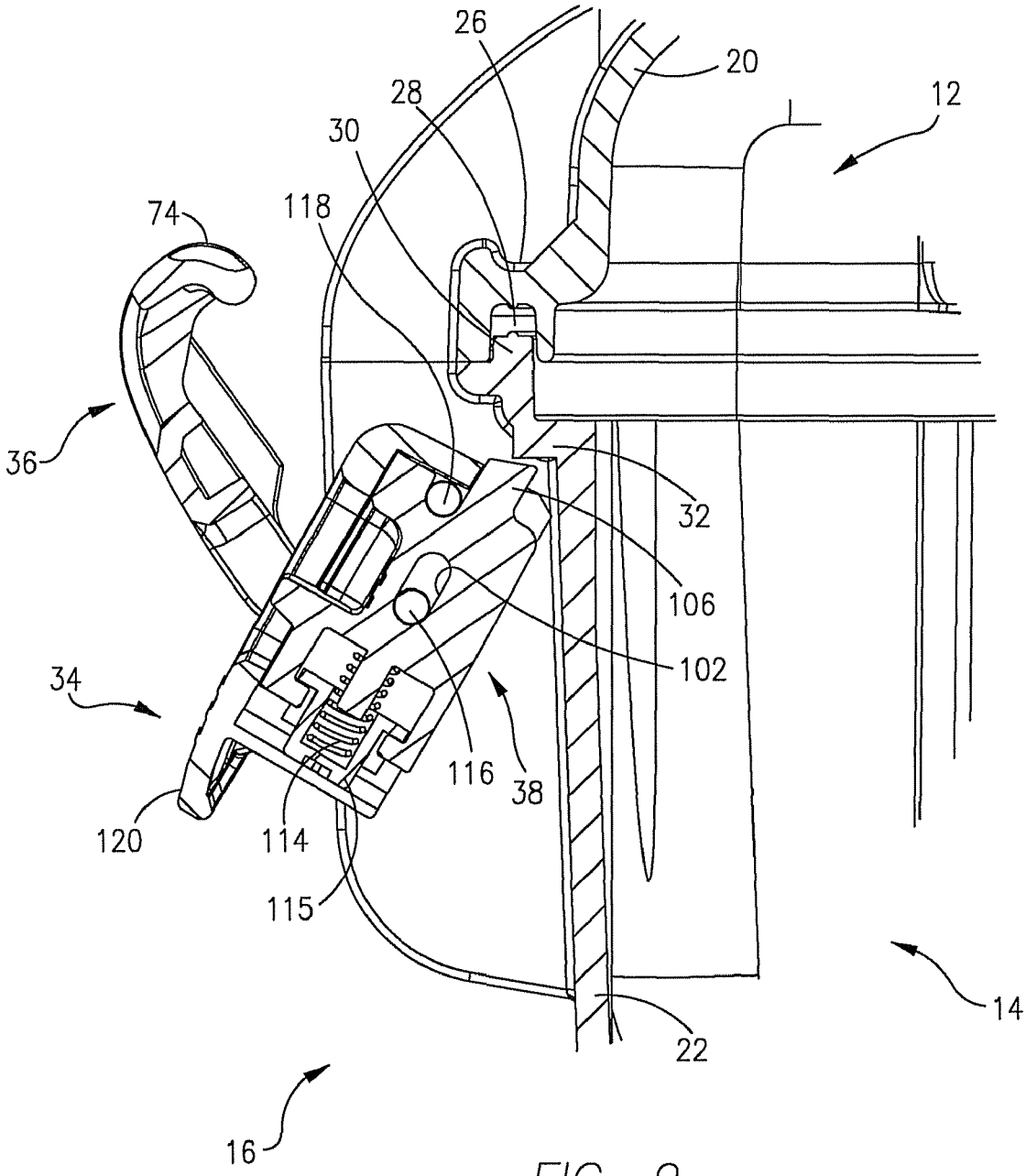
FIG. 9 is view similar to FIG. 8 except with the latch locking member disengaged from the seat formed in the top case shell.

Referring now to FIGS. 6-9, the operation of the latch mechanism 16 of this invention is illustrated. In FIG. 6, the latch mechanism is shown in a locked position with the hook element 74 of the latch locking element 36 in engagement with the seat 26 in the front wall 20 of the top case shell 12 and the locking member 106 of the latch release 38 contacting the ledge 32 in the front wall 22 of the bottom case shell 14. The hook element 74 cannot disengage the seat 26 unless the latch body 34 is pivoted in a clockwise direction relative to the front wall 22 of the bottom case shell 14, as seen in FIGS. 8 and 9. If one pulls on the tab 120 formed by the downwardly extending end of the front wall 40 of latch body 34, with the latch mechanism 16 in the position shown in FIG. 6, the locking member 106 of the latch release 38 bears against the ledge 32 of the bottom case shell 14, thus preventing such clockwise pivotal motion.

The latch release 38 is maintained in the locked position by operation of the spring 114. As seen in FIG. 6, the spring 114 urges the latch release 38 in an upward direction so that the locking member 106 bears against the ledge 32. At the same time, the case mounting pin 118 is received within the recess 104 in the top wall 96 of the latch release 38, and the latch assembly pin 116 is located at the bottom of the sleeve 102 carried by the latch release 38.

In order to allow pivotal movement of the latch body 34, and, in turn, permit disengagement of the hook element 74 of the latch locking element 36 from the seat 26 in the top case shell 12, the latch release 38 must be moved to a release position shown in FIG. 7. One may insert his or her finger through the window 58 in the front wall 40 of the latch body 34 and into contact with the button 100 extending through the opening 101 in the front wall 92 of the latch release 38. The latch release 38 is then pushed downwardly, against the force exerted by the spring 114, to a release position wherein the locking member 106 formed in the top wall 96 of the latch release 38 disengages the ledge 32 in the front wall 22 of the bottom case shell 14. The user is provided with an indication of the release position because the latch assembly pin 116 will contact the upper end of the sleeve 102 in the latch release 38 when the latch release 38 is pushed downwardly to the release position.

With the latch release 38 in the release position, the latch body 34 may be pivoted in a clockwise direction about the case mounting pin 118 by grasping the tab 120 at the bottom of the latch body 34 and pulling outwardly relative to the bottom case shell 14, as illustrated in FIG. 8. Such motion is the first "throw" of the latch mechanism 16. With the latch body 34 in the position depicted in FIG. 8, the hook element 74 of the latch locking element 36 can begin to disengage from the seat 26. When the hook element 74 assumes the position shown in FIG. 8, the latch body 34 may then be pivoted in the opposite, counterclockwise direction, e.g. the second "throw" of the latch mechanism 16, so that the hook element 74 may completely disengage the seat 26 as shown in FIG. 9. The top and bottom case shells 12, 14 may then be opened.

Closure of the latch mechanism 16 is accomplished by reversing the steps noted above. The latch body 34 is initially pivoted in the clockwise direction to allow the hook member 74 of the latch locking element 36 to assume the position relative to the seat 26 shown in FIG. 8. The latch body 34 may then be pivoted in the counterclockwise direction so that it rests along the front wall 22 of the bottom case shell 14 as depicted in FIGS. 6 and 7. The spring 114 urges the locking member 106 of latch release 38 to the locked position, and the case 10 is now locked in such a way that inadvertent contact with the latch body 34 cannot cause the latch mechanism 16 to open without first moving the latch release 38 to the release position.

Latch Mechanism of FIGS. 10-15

Referring now to FIGS. 10-15, an alternative embodiment of a latch mechanism 130 according to this invention is illustrated. It may be desirable in some applications to provide additional security against inadvertent opening of the case 10 when in the locked position. Such added security is provided by certain changes to the construction of the latch mechanisms 16 and 18, and the bottom case shell 14, as described below. Except for such changes, the structure and operation of the latch mechanism 130 is the same as that of latch mechanisms 16, 18, and therefore the same reference numbers are employed to identify common structure. Only one latch mechanism 130 is shown in FIGS. 10-15, it being understood that a second latch mechanism 130 would be employed with case 10.

Retention of the latch mechanisms 16, 18 in the embodiment of FIGS. 1-9 is achieved by the engagement of locking member 16 extending from the top wall 96 of latch release 38 and a ledge 32 on the front wall 22 of the bottom case shell 14. It is possible with this construction to grasp the tab 120 at the bottom of the latch body 34 and pull upwardly, causing the latch body 34 to pivot outwardly in a manner such as shown in FIG. 8.

Figure 11:
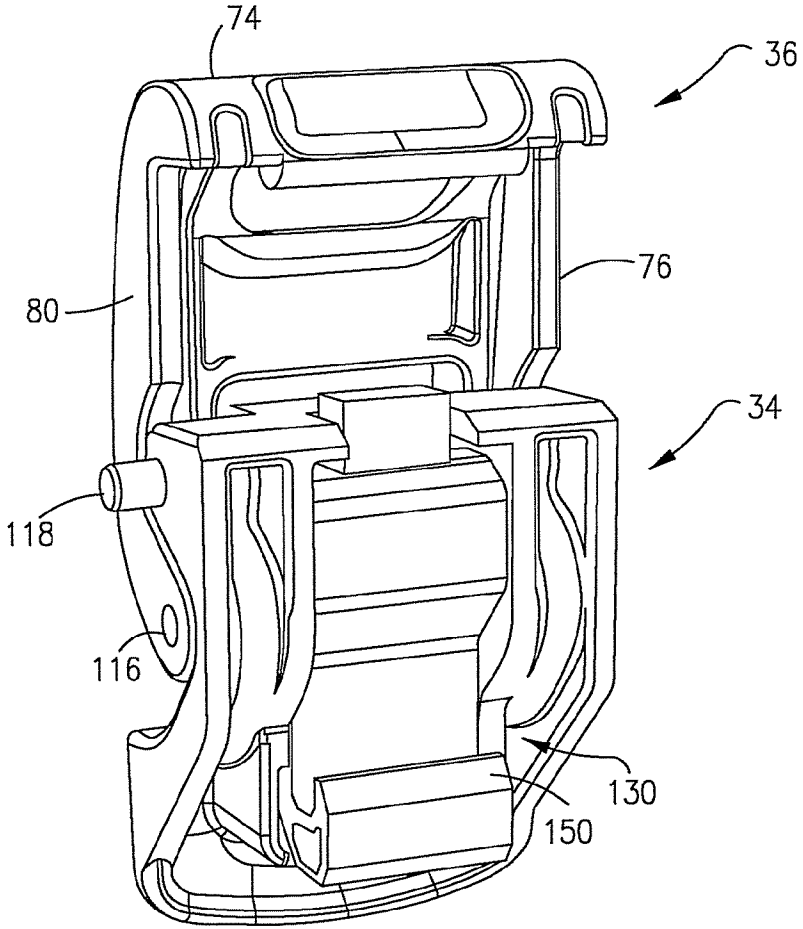
FIG. 11 is a view similar to FIG. 4 except depicting the latch body connected to the embodiment of the latch release shown in FIG. 10.
Figure 10:
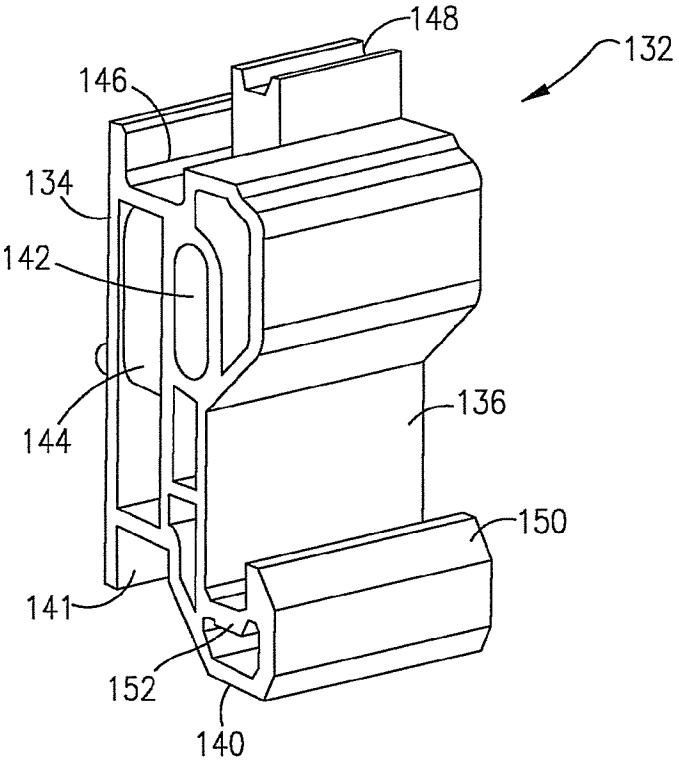
FIG. 10 is a perspective view of an alternative embodiment of the latch release of this invention.

The latch mechanism 130 is designed to avoid the potential, inadvertent pivoting of the latch body 34 prior to movement of the latch release 38 to its release position. To that end, a latch release 132 is provided having a front wall 134, a back wall 136, a top wall 138 and a bottom wall 140 which are interconnected to collectively form an interior within which a sleeve 142 is mounted. A cavity 141 is formed between the front and back walls 134, 136 which receives the coil spring 114. See FIG. 12. A button (not shown), such as button 100 of the latch release 38, extends from the bottom wall 140 through an opening 144 in the front wall 134. The top wall 138 has a recess 146 and an upwardly extending first locking member 148 having a generally U-shaped upper surface. A second locking member is provided in the form of a lip 150, which is joined to the back wall 136 by a horizontally extending support 152. The latch mechanism 130 is assembled by mounting the latch release 132 to the latch body 34 in the same manner as described in connection with a discussion of FIGS. 1-6, and as shown in FIGS. 4, 5 and 11.

Figure 12:
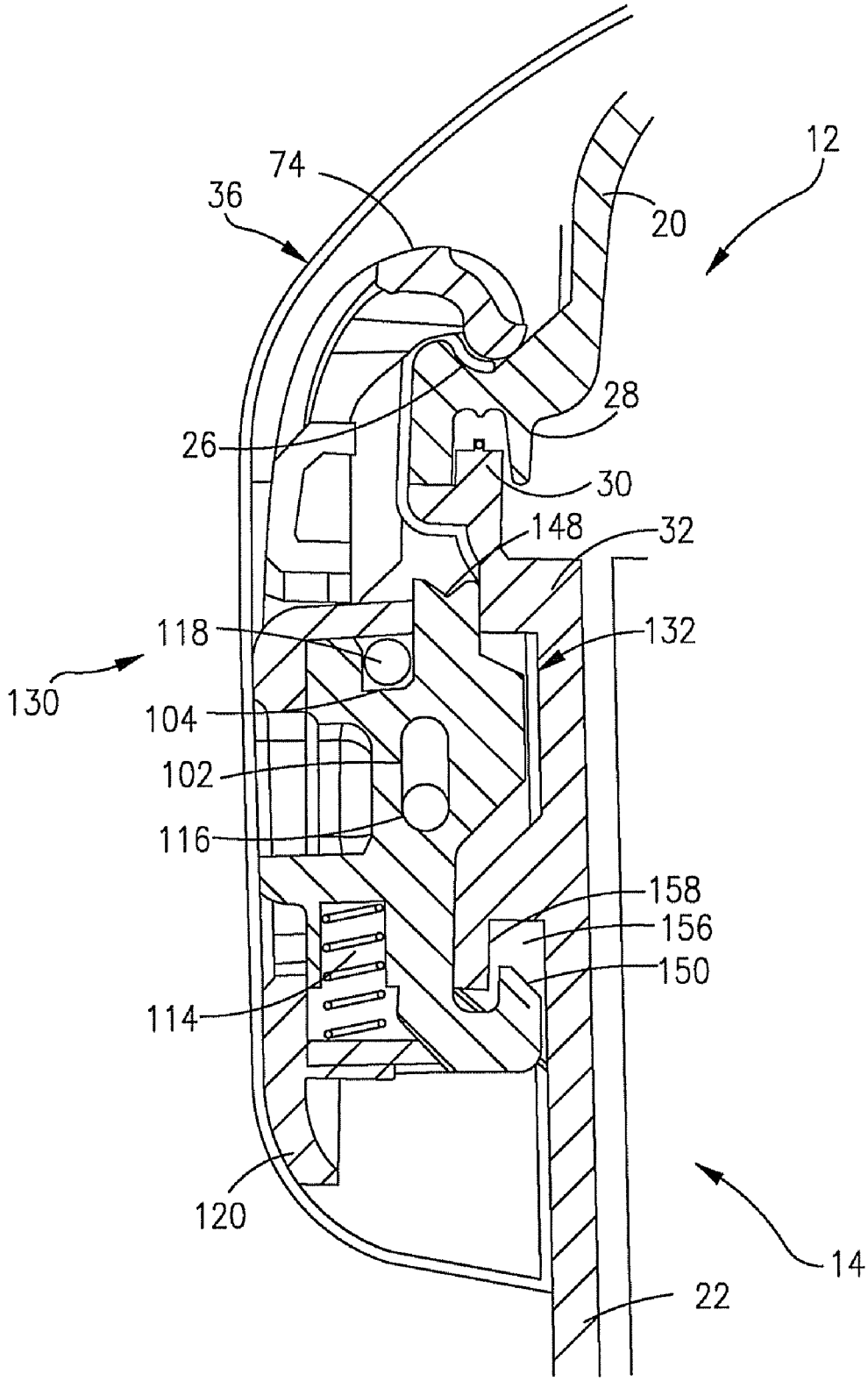
FIG. 12 is a view similar to FIG. 6, except with the latch release of FIG. 10.
Figure 13:
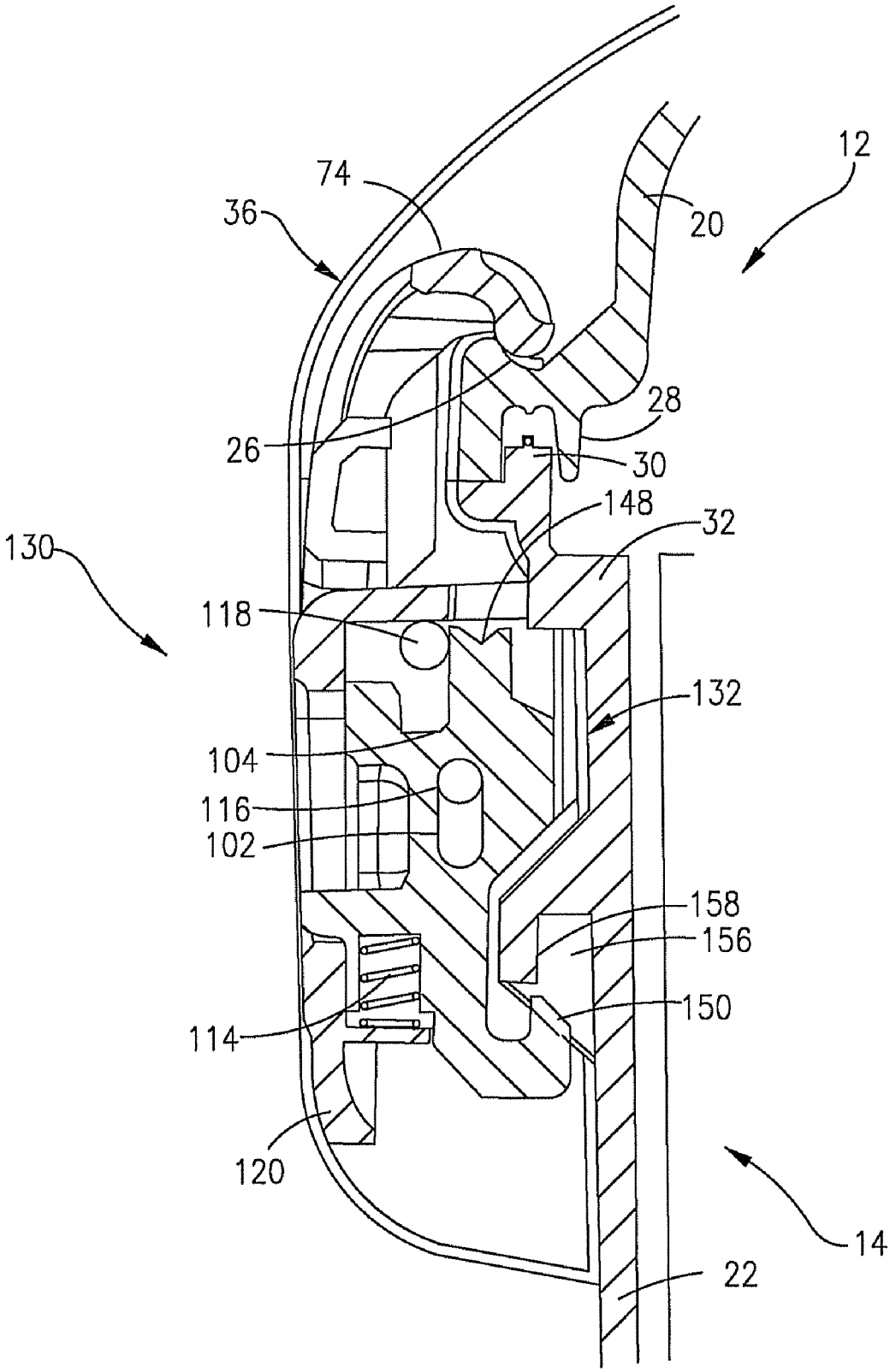
FIG. 13 is a view similar to FIG. 7, except with the latch release of FIG. 10.
Figure 14:
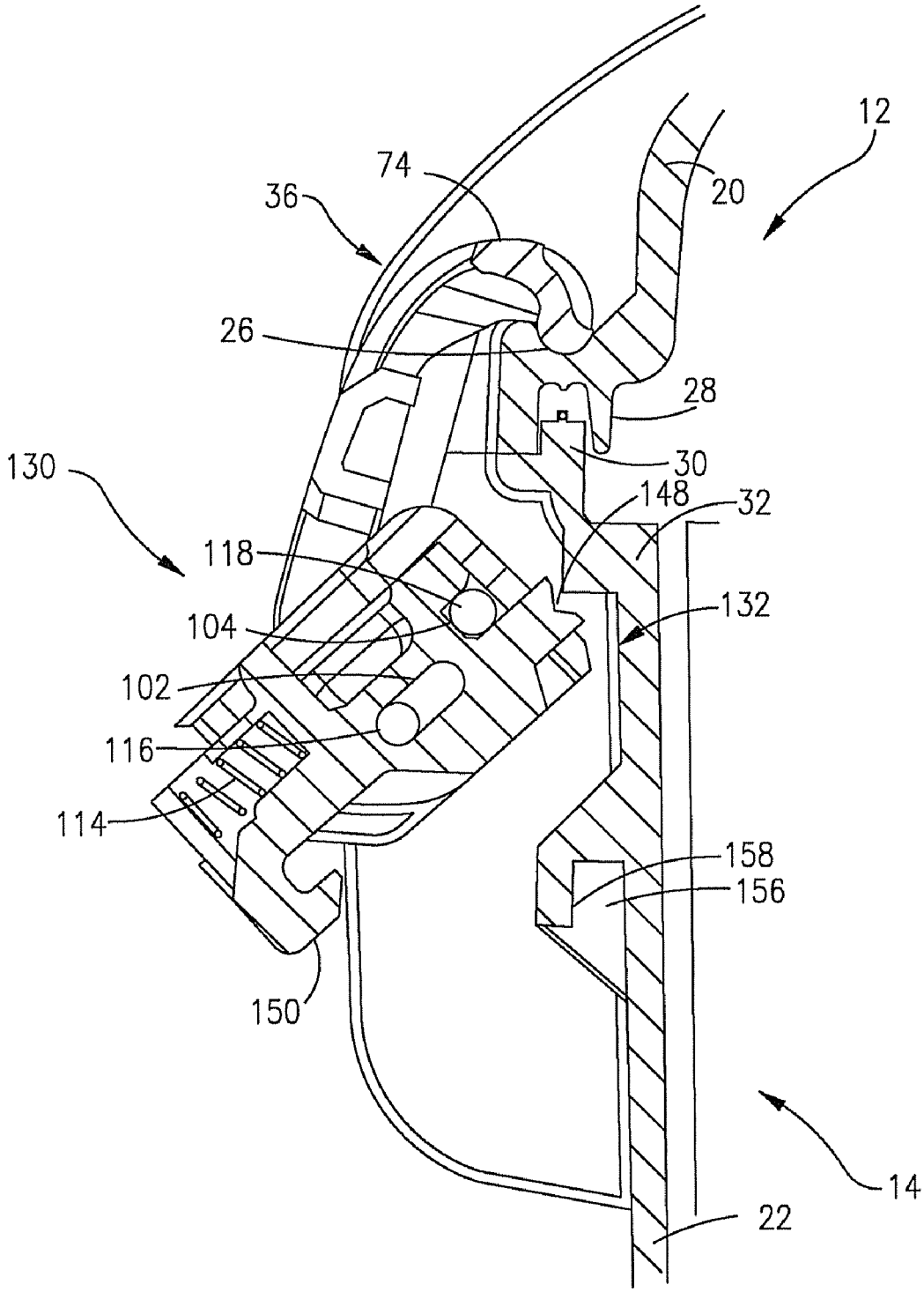
FIG. 14 is a view similar to FIG. 8, except with the latch release of FIG. 10.
Figure 15:
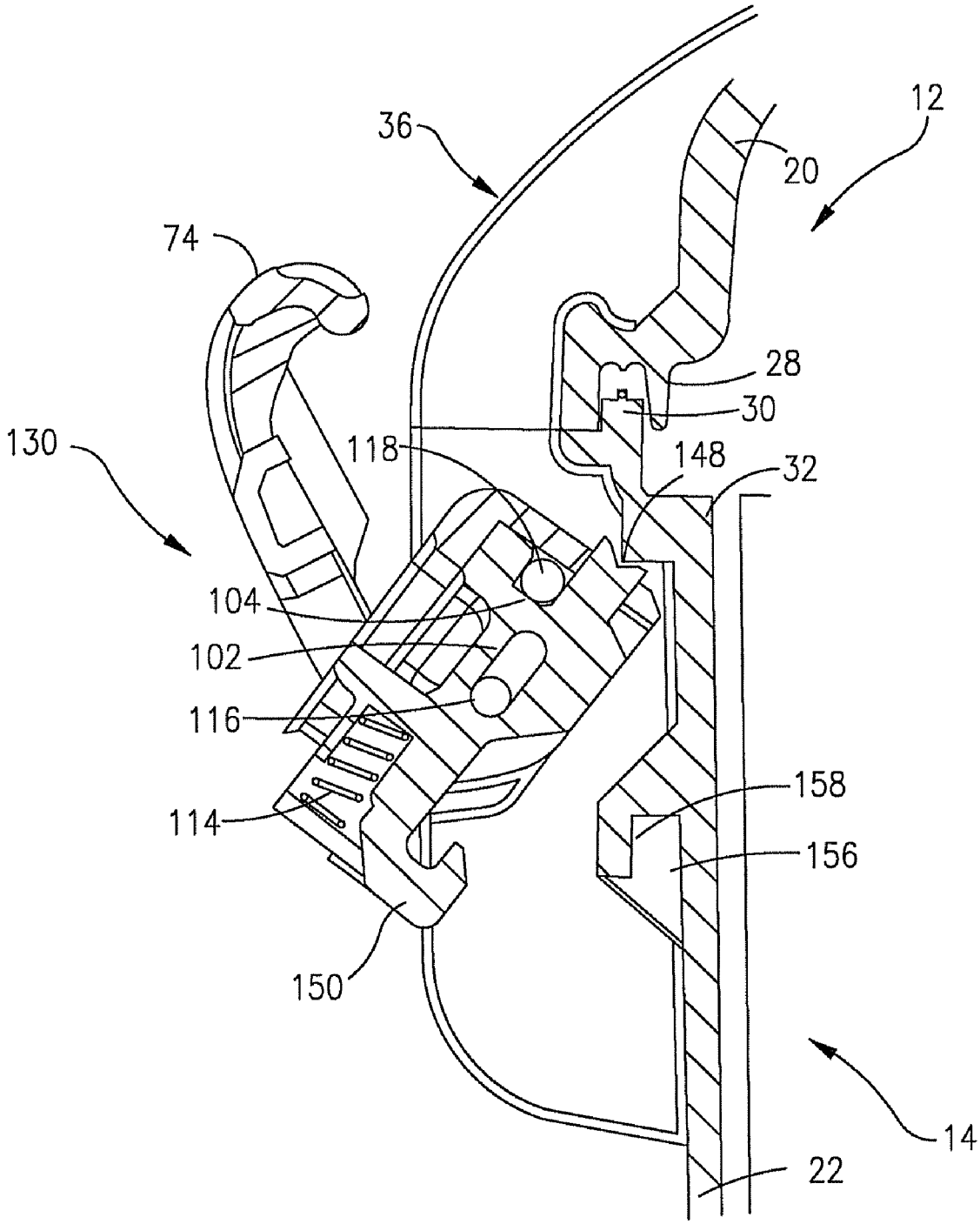
FIG. 15 is a view similar to FIG. 9, except with the latch release of FIG. 10.

The operation of the latch mechanism 130 depicted in FIGS. 12-15 is the same as that described above for the latch mechanism 16, and shown in FIGS. 6-9, except for the added second locking member or lip 150 that substantially prevents inadvertent release of the latch mechanism 130 prior to movement of the latch release 132 to its release position. As shown in FIG. 12, for example, with the latch release 38 in a locked position the second locking member or lip 150 is located within a cavity 156 formed by a locking arm 158 extending outwardly from the front wall 22 of bottom case shell 14. The locking arm 158 engages the lip 150 and prevents movement of the latch release 132 upwardly relative to the bottom case shell 14 unless the latch release 132 is first moved to its release position illustrated in FIG. 13. The first locking member 148 formed in the top wall 138 of the latch release 132 performs essentially the same function as the locking member 106 of the latch mechanisms 16 and 18. In both embodiments, the locking members 106 and 148 engage the ledge 32 formed in the front wall 22 of bottom case shell 14 to provide additional protection from inadvertent pivoting movement of the latch body 34. Movement of the latch release 132 to its release position shown in FIG. 13 allows the first locking member 148 to clear the ledge 32, and the second locking member or lip 150 to extend past the locking arm 158, thus allowing pivotal movement of the latch body 34 in the same manner as described above in connection with a discussion of FIGS. 6-9

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A case, comprising:

a top case shell having a front wall formed with a seat, a bottom case shell having a front wall formed with a ledge and a locking arm, said top and bottom case shells being pivotally connected to one another and movable between an open position and a closed position;

a latch mechanism comprising:

(i) a latch body pivotally mounted to said bottom case shell, said latch body being movable between a first position with respect to said front wall of said bottom case shell and a second position;

(ii) a latch locking element formed with a hook member, said latch locking element being pivotally mounted to said latch body and movable between a locked position wherein said hook member engages said seat of said top case shell and an unlocked position wherein said hook member disengages said seat, said latch locking element being retained in said locked position except upon movement of said latch body to said second position;

(iii) a latch release formed with a first locking member and a second locking member, said latch release being coupled to said latch body with a spring member connected between said latch release and said latch body, said latch release being positioned in a locked position with said latch body in said first position wherein said first locking member engages said ledge of said bottom case shell and said second locking member engages said locking arm of said bottom case shell, said latch release being moveable in a substantially linear direction against the force exerted by said spring member to a release position wherein said first locking member disengages said ledge and said second locking member disengages said locking arm to permit movement of said latch locking element to said unlocked position.

2. The case of claim 1 in which said latch body includes a top wall, a bottom wall and opposed inner side walls collectively forming a cavity, said latch release being mounted within said cavity.

3. The case of claim 1 in which said back wall of said latch release is formed with an outwardly extending lip which comprises said second locking member, said lip contacting said locking arm with said latch release in said locked position.

4. The case of claim 1 in which said latch body further includes opposed outer side walls each spaced from one of said inner side walls, a first bearing surface being formed between one of said inner and outer side wall pairs and a second bearing surface being formed between the other of said inner and outer side wall pairs.

5. The case of claim 1 in which said latch locking element includes a first pivot arm spaced from a second pivot arm, said hook member extending between said first and second pivot arms.

6. The case of claim 5 in which said first and second pivot arms are pivotally connected to said latch body so that said first and second pivot arms each rest against one of said first and second bearing surfaces of said latch body.

* * * * *